United States Patent [19]

Yamamoto

[11] 4,015,909

[45] Apr. 5, 1977

[54] TAMPING MACHINE

[76] Inventor: Shinzo Yamamoto, 21-1 Kajiyama 2-chome, Tsurumi, Yokohama, Kanagawa, Japan

[22] Filed: July 27, 1976

[21] Appl. No.: 709,020

[30] Foreign Application Priority Data

Jan. 24, 1976 Japan ..... 51-7149[U]

[52] U.S. Cl. ..... 404/133; 173/118

[51] Int. Cl.[2] ..... E01C 19/34

[58] Field of Search ..... 404/133; 173/119, 118, 173/120, 121; 299/37, 94

[56] References Cited

UNITED STATES PATENTS

| | | | |
|---|---|---|---|
| 509,373 | 11/1893 | Hoffmann | 173/118 X |
| 711,998 | 10/1902 | McConney | 173/118 X |
| 837,118 | 11/1906 | Rekar | 173/118 X |
| 2,185,471 | 1/1940 | Mall | 173/120 |
| 3,090,286 | 5/1963 | Kestel | 404/133 |
| 3,270,635 | 9/1966 | Kestel | 404/133 |
| 3,286,790 | 11/1966 | Kestel | 404/133 X |
| 3,308,728 | 3/1967 | Brown | 404/133 |
| 3,492,924 | 2/1970 | Fors | 404/133 |
| 3,847,498 | 11/1974 | Grane | 404/133 |

*Primary Examiner*—Nile C. Byers
*Attorney, Agent, or Firm*—Frank J. Jordan

[57] ABSTRACT

In the manually guided tamping machine comprising a vertically long casing, a motor mounted thereon, crank means driven thereby, a cylinder snugly mounted to be vertically movable in said casing, a percussion piston in said cylinder, and a pair of coil springs disposed above and below said piston in said cylinder so as to generate vibrating reciprocation to be transmitted to the tamper foot, the invention is characterized by disposing said crank means not at the casing top as usual wherein a relatively long and thin connecting rod or ramrod must pass through the coil spring but vertically amid and in the cylinder, and providing a pair of pistons instead of one in the prior art so as to be subjected to alternate upward and downward movement by means of a pair of connecting rods pivotally linked to said crank means. A shaft for driving said crank means is transversely extended through a vertical slot formed in the cylinder wall and bearings mounted on the casing. Thus it is possible to make construction and assembling work simpler and cost cheaper.

4 Claims, 2 Drawing Figures

TAMPING MACHINE

Figure 1:
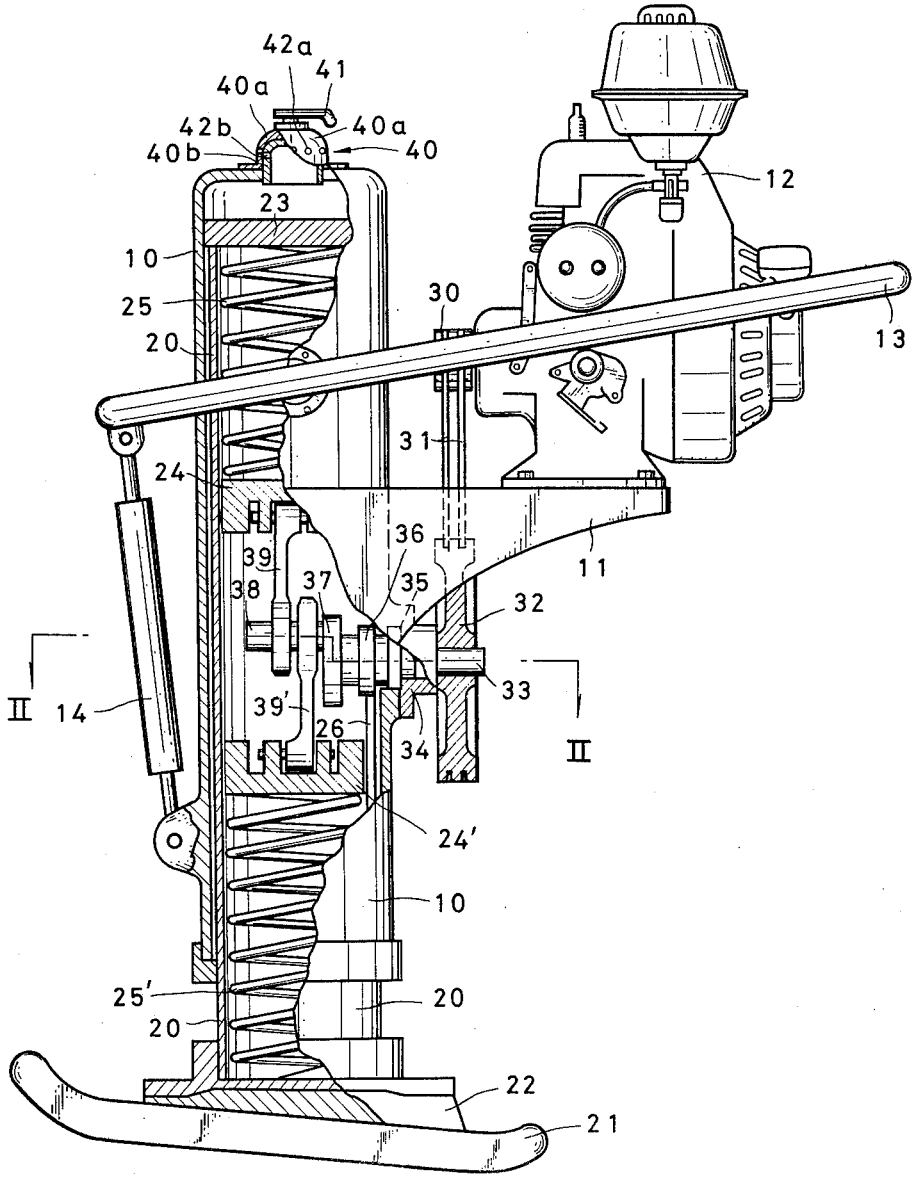

The present invention relates to a tamping machine, and more particularly to a manually guided motor driven tamper.

Various types of such ground tamping devices are known where the devices are commonly provided with a prime mover such as an internal combustion engine of which rotation output drive is converted to vertically reciprocating movement which is in turn converted to vibration by means of a spring system which vibrating reciprocation is transmitted to a foot for tamping.

In a typical tamping machine, a vertically long housing to which the motor is mounted has a crank drive arranged therein at the upper portion so that a connecting rod is vertically and reciprocatingly driven in the casing. The lower end of the downwardly extended connecting rod is connected with the upper end of a cylinder so as to reciprocate said cylinder in the long casing. The cylinder contains therein a piston and a pair of coil springs each arranged on the opposite side thereof for supporting the piston against the upper and lower ends of the cylinder. A ram rod, one end of which is connected to said piston to be naturally located amid the vertically long cylinder, extends downwardly out of the cylinder as well as the casing so that the other end of said ram rod is connected to the foot. Such construction is shown for instance in U.S. Pat. No. 3,630,127.

Or alternately, the lower end of said connecting rod is connected not to the casing but to the piston positioned amid and in the vertical cylinder. In this construction the foot is connected to the lower end of the cylinder. Such vibration system is shown for instance in U.S. Pat. No. 3,308,729.

As well known to or readily understood by those skilled in the art, the ram rod of the prior art as firstly referred to above is inevitably long and thin since it must extend passing through the coiled spring and connecting the foot to the piston of which normal and neutral level lies around at the middle of the vertically long cylinder and consequently of the casing. It would be obvious that there is caused often breakage or giving-way of such ram rod when subjected to severe work. The arrangement of the ram rod as referred to above makes it difficult not only to exchange the broken rod for a new one but also to assemble the ram rod when manufacturing the device in the first place. In order to prevent the ram rod from being so readily broken, various protecting means must be provided which causes increase of the number of the parts and makes the assembly more troublesome which in turn raise the cost.

This is the same as to the prior art secondly referred to above, in which what is connected with the piston is not the ram rod but the connecting rod.

Furthermore, according to said construction of the known tampers, there is inevitably caused relative rotation between the reciprocating cylinder and the vibrating piston, and consequently between the foot and the casing, the former of which is fixedly connected to said piston via the ram rod while the latter is fixedly connected to the cylinder via the crank drive in said first prior art, and the former of which is fixedly connected directly to the cylinder while the latter is fixedly connected to the piston via the crank drive in said second prior art. Such rotation of the foot relative to the casing must be avoided since the foot is inclined relative to the casing so that the tamping machine may move forwards as the foot vibrates and since the operator manually guide the direction of said forward walking by means of the handle arm fixed to the casing. In order to avoid such undesirable angular movement, there is usually provided one or two vertical rods each one lower end of which is fixed to the foot while the upper portion of said rods is slidably received by a sleeve fixed to the casing. This increases the number of the parts which further adversely affects on the assembling work and the cost.

It is an object of the present invention, thus, to overcome and avoid the defaults and disadvantages of the conventional tamping machines.

A particular object of the invention is to provide a tamping machine having less parts and of more simple construction so as to make the assembling easier and the cost cheaper.

Said objects can be attained according to the invention fundamentally by locating the crank means not above the cylinder as in the conventional machines but vertically middle in the cylinder and arranged between a pair of pistons so that a pair of coil springs each arranged between said piston and upper or lower end wall may periodically be subjected to alternate compression, and so that the foot connected directly to the cylinder lower end is vibratingly reciprocated.

By virtue of this unique arrangement, it is possible to simplify the means for preventing the relative rotation between the foot and the casing.

Additionally it comes to be possible owing to the unique arrangement to utilize a chamber formed in the casing at the upper end thereof and defined by a piston to which the upper end of the upper coil spring is fixed as an air-tight chamber for adjusting the vertical travel stroke of the cylinder by controlling open degree of a valve provided in said chamber.

Thus another object of the invention is to provide a tamping machine of which tamping force may easily be controlled by means of a simple construction device.

Figure 2:
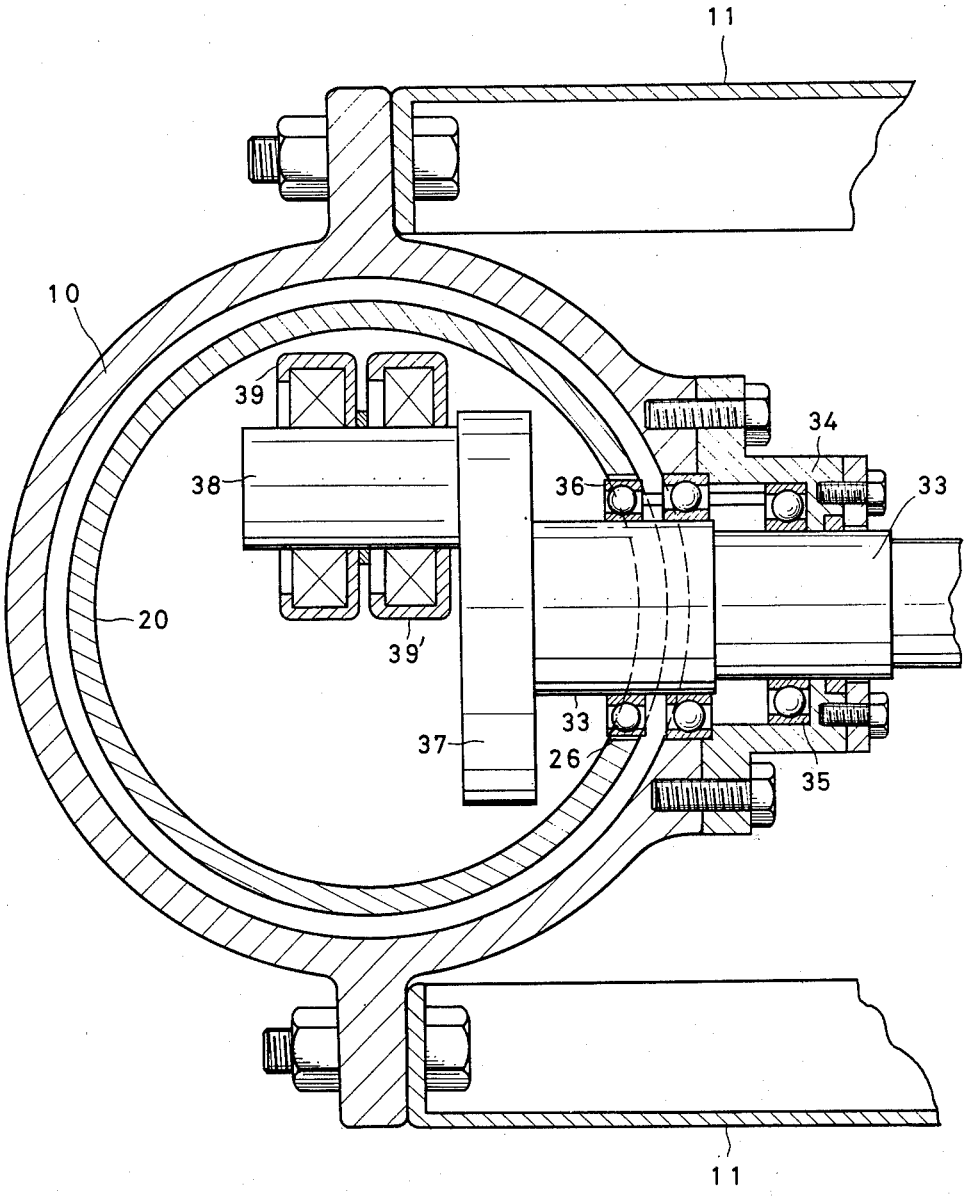

Still other objects and advantages may readily be appreciated by studying the following detailed explanation to be made in reference to the accompanying drawing, in which;

FIG. 1 is a side elevation of the tamping machine according to the invention partly cut away and in section, and FIG. 2 is a cross section in an enlarged scale and taken along the line II — II in FIG. 1, in which the angular position of the crank pin is different from that in FIG. 1 for the sake of clarity.

The tamping machine of the invention comprises a vertically long cylindrical casing 10 of which upper end is closed but the lower end is open. To said casing is fixed a bracket 11 on which an internal combustion engine 12 is mounted. There will be no need for more minutely explaining such engine for the invention has no connection with the engine itself. There is provided a handle arm 13 connected to said casing 1 for manually guiding the tamping machine. It is preferable to provide a shock absorber 14 between the handle arm and the casing.

In said casing 10 is mounted a cylinder 20 of the outer diameter slightly less than the inner diameter of the casing 10 so as to be vertically movable guided therein. On the lower end of said cylinder 20 is fixed a foot 21 via a suitable fitting 22 so as to be inclined relative to the longitudinal axis of the machine for the purpose of the self walking as usual and referred to above. The upper end of said cylinder 20 is closed by a piston 23 of which peripheral surface may air-tightly abut on the inner wall of the casing 1. A piston ring or the like may be provided for the air-tight sealing. A pair of pistons 24, 24', different from one percussion piston in the prior art, are snugly mounted in said cylinder 20 to be vertically movable guided therein. A pair of coiled springs 25, 25' are arranged respectively between the cylinder upper end wall or the piston 23 and the piston 24, and between the cylinder lower end wall or the fitting 22 and the piston 24'.

On the output shaft of the motor 12 is mounted a pulley 30, around which a belt or belts 31 ae set so as to transmit the drive to another pulley 32. Said pulley 32 is mounted on a transversely extended shaft 33 at the outer end thereof. Said shaft 33 is rotatably journalled by bearings 34, 35 provided on the wall of the casing 10 substantially middle the vertical length thereof and further extending through a slot 26 formed in the cylinder wall into the cylinder 20. The vertical slot 26 formed in the cylinder wall is of such a width as guiding the surface of the outer race of a bearing 36 on the shaft 33 so as to allow free rotation of said shaft but prevent relative angular movement between the inner cylinder 20 and the outer casing 10, and of such a length as allowing vibrating reciprocation of the cylinder 20 relative to the casing 10. At the inner end of the shaft 33, there is mounted a disk 37 eccentrically planted with a crank pin 38 on which a pair of connecting rods 39, 39' are mounted each at one end so as to respectively vertically extend in opposite direction and have the respective other ends pivotally connected with each of said pistons 24, 24'.

There will be no need for particularly explaining the operation of the tamping machine, but it is only added that the upper coil spring 25 is subjected to compression in the position illustrated in FIG. 1 while the lower coil spring 25' is compressed when the shaft 33 is rotated 180° whereby the pair of coil springs are subjected to alternate compression like as in the usual vibration system referred to at the preamble of the specification.

According to a preferable feature of the invention, there may be provided a valve 40 at the top end wall of the casing 10 for controlling the uppermost stroke limit of the vibratingly reciprocating cylinder 20. The valve 40 may comprise a fixed outer sleeve **40*a* and an inner sleeve 40*b* rotatably mounted therein, the latter having an handle 41 to be manually rotated. There are provided a plurality of holes 42*a* and 42*b* respectively in the walls of said outer and inner sleeves so that allignment of each of the outer and inner holes may open the valve. When throttling the valve 40, the upward movement of the cylinder 20 is resisted by compressed air in the chamber defined by the air-tight piston 23 at the top in the casing 10. Such simple adjustment of the simple construction means can control vibration frequency or tamping force of the foot 21 so as to accord with the instant work to be required. This secondary preferable feature is derived from the fundamental new feature of the invention that the crank drive is arranged vertically middle in the spring containing cylinder 20.**

It would have been appreciated that according to said fundamental feature the necessary parts for constituting this sort of tamping machine can considerably be decreased which results in not only simplifying the construction but also reducing mechanical weak points. Furthermore it is now obvious that assembling of the parts can be made far easier according to the invention than the prior art, which in addition to said reduction of the parts can considerably lower the machine cost.

It is to be noted that various modifications can be made without departing from the spirit of the invention so far as the interpretation or construction of the Claims to be given hereinafter may allow this.

For instance the disk 37 on which the crank pin 38 is eccentrically planted may be substituted with a usual crank arm.

It is possible even to omit the connecting rods 39, 39' in the embodiment as explained and illustrated. The two percussion pistons 24, 24' which are vertically connected as if one piston by means of said two connecting rods may be substituted with one plate member vertically arranged so as to integrally combine said two pistons and face at a right angle to the transversely extending crank pin 38. Said crank pin 38 may directly, namely without using the connecting rods, engage in a transverse slot formed in said plate member. Of course it is preferable to provide a bearing on said crank pin for providing smooth guide of the crank pin in the slot. According to this modification, it is possible not only to further decrease the number of the necessary parts, make assembly easier and consequently cost cheaper, but also to make the vertical length of the machine shorter and consequently lower the gravity center.

What is claimed is:

1. A tamping machine comprising a vertically long casing having a lower end open, a prime mover supported on said casing, a cylinder snugly mounted in said casing so as to be vertically movable therein and having upper and lower ends respectively closed, a foot member fixed to said cylinder at the lower end thereof exposed out of said casing lower end, a pair of pistons each snugly mounted in said cylinder so as to be vertically movable therein as a unit, a pair of coiled springs disposed in said cylinder respectively between the closed upper end thereof and one of said pistons and between the closed lower end of said cylinder and the other piston, a drive shaft having an outer end drive-transmittingly connected with said prime mover via transmission means and transversely extending through bearings mounted at the wall of said casing and a vertically long slot formed in the wall of said cylinder so as to dispose the inner end of said drive shaft between said two pistons, and crank means drive-transmittingly connected with said drive shaft inner end so that rotation output drive of said prime mover may subject the unit of said pistons to vertical reciprocation and consequently said two springs to alternate compression for causing vibrating reciprocation of said foot member.

2. The tamping machine as claimed in claim 1, in which said crank means comprises a base member mounted on said drive shaft inner end and a crank pin eccentrically planted on said base member, on said crank pin being pivotally mounted a pair of connecting rods respectively vertically extending one upwardly while the other downwardly so that each of the other ends of said connecting rods is pivotally connected to each of said pistons.

3. The tamping machine as claimed in claim 1, in which said crank means comprises a base member mounted on said drive shaft inner end and a crank pin eccentrically planted on said base member, and said two pistons are connected together by means of a plate member vertically arranged therebetween, which plate member has a transversely long slot for receiving said crank pin so that rotation of said drive shaft may cause vertical reciprocation of said plate member and two pistons integrated therewith.

4. The tamping machine as claimed in claim 1, in which said cylinder has a lid member fixed thereto at the upper end so as to serve as a piston and form an air tight chamber in the casing, and said casing has a valve at the upper end thereof so as to control air pressure in said chamber.

* * * * *